US006245413B1

(12) United States Patent
Kenmochi et al.

(10) Patent No.: US 6,245,413 B1
(45) Date of Patent: Jun. 12, 2001

(54) CLEANING SHEET

(75) Inventors: Yasuhiko Kenmochi; Masatoshi Fujiwara; Yoshinori Tanaka, all of Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 0 days.

(21) Appl. No.: 09/391,821

(22) Filed: Sep. 8, 1999

(30) Foreign Application Priority Data

Sep. 24, 1998 (JP) ..... 10-269632

(51) Int. Cl.[7] ..... B32B 3/02

(52) U.S. Cl. ..... 428/157; 428/141; 428/156; 428/192; 428/195; 442/381; 442/400; 442/401; 19/262; 15/209.1

(58) Field of Search ..... 428/141, 156, 428/157, 192, 195; 442/381, 400, 401; 19/262; 15/209.1

(56) References Cited

U.S. PATENT DOCUMENTS 4,298,649 * 11/1981 Meitner ..... 428/198
5,962,112 * 10/1999 Haynes et al. ..... 428/198
6,013,349 * 1/2000 Takeuchi et al. ..... 428/152
6,143,393 * 11/2000 Abe et al. ..... 428/131

FOREIGN PATENT DOCUMENTS 05192284 8/1993 (EP) .
05245090 9/1993 (EP) .
0774229A2 5/1997 (EP) .
0777997A2 6/1997 (EP) .
0777997A3 1/1998 (EP) .
10005163 1/1998 (EP) .
0774229A3 4/1998 (EP) .
0865755A1 9/1998 (EP) .
0943425A1 9/1999 (EP) .
05245090 9/1993 (JP) .
09149873 6/1997 (JP) .

* cited by examiner

*Primary Examiner*—Terrel Morris
*Assistant Examiner*—Norca L. Torres
(74) *Attorney, Agent, or Firm*—Darby & Darby

(57) ABSTRACT

A cleaning sheet which is attached to a cleaning tool during use which comprises a wiping region having a wiping layer and attaching regions positioned on both sides of the wiping region, where a plurality of recesses are formed at intervals along boundaries between the wiping region and the attaching regions such that the recesses extend from the boundaries toward the center of the wiping region.

11 Claims, 5 Drawing Sheets

CLEANING SHEET

FIELD OF THE INVENTION

The present invention relates to a disposable cleaning sheet for attachment to a cleaning mop or the like, for wiping dust from a surface to be cleaned such as floor, and more particularly to a cleaning sheet which has its dust collecting ability enhanced by making it possible to use the whole wiping area of the cleaning sheet efficiently.

BACKGROUND OF THE INVENTION

In general, the "disposable cleaning sheet" collects dust by making use of complicatedly entangled fibers on its surface, and during use is attached, for example, to a plate with a flat bottom face which is provided at the leading end of a cleaning mop.

In the above case of attaching the cleaning sheet to a mop in order to perform a wiping operation, a problem arises due to the flat bottom face of the plate. Specifically, the cleaning sheet can not readily collect the dust at its middle region, which covers the center of the bottom face of the plate while collecting the dust at its peripheral edge regions covering the edge portions of the plate. As a result, the entire cleaning sheet cannot be effectively exploited.

FIG. 8 is a side section showing a prior art cleaning sheet for eliminating the aforementioned defect while attached to a cleaning mop; FIG. 9 is a side section showing another prior art cleaning mop for eliminating the aforementioned defect while having a cleaning sheet attached thereto; and FIG. 10 is a side section showing the cleaning sheet of the prior art shown in FIG. 8 in actual use.

The cleaning sheet, as shown in FIG. 8, belongs to the same kind as that disclosed in Unexamined Published Japanese Patent Application No. 10-5163, for example. A sheet 31 is made thicker at its middle region 31*a* than the peripheral edge regions 31*b* and 31*b*. When this sheet 31 is attached to a cleaning mop M or the like, the middle region 31*a* is positioned at the central region of a plate Mp of the cleaning mop M. When a surface to be cleaned such as a floor is cleaned with that sheet 31, the middle region 31*a* comes into abutment against the surface to be cleaned while forming an indented space 32*a* between the peripheral edge region 31*b* and the surface to be cleaned. By moving the cleaning mop M along the surface to be cleaned to perform the wiping operation, a relatively large piece of dust can be collected in the indented space 32*a* to enhance the dust collecting effect.

In the prior art device shown in FIG. 9, unlike that shown in FIG. 8, the bottom face of the plate Mp of the cleaning mop M itself is formed into a bulging shape to form indented spaces 32*b* and 32*b* between a central portion M1 and edge portions M2 and M2, respectively. When the wiping operation is performed with the bottom face (including the central portion M1, the indented spaces 32*b* and the edge portions M2) of the cleaning mop M covered with a flat cleaning sheet (or a flat sheet) 31', the relatively large piece of dust can be collected in the indented spaces 32*b*.

However, the prior art thus far described suffers from the following problems. In the prior art shown in FIGS. 8 or 9, either the area of the middle region 31*a* of the cleaning sheet 31 or the area (i.e., the area of the cleaning sheet 31' in contact with the surface to be cleaned) of the central portion M1 of the cleaning mop M is smaller than the entire area of the bottom face of the cleaning mop M. As a result, the cleaning mop M is liable to become unstable with respect to the surface to be cleaned. For example, the frictional force acting upon the cleaning mop M when the cleaning mop M is moved in a direction X along the surface to be cleaned is liable to incline the plate Mp with respect to the surface to be cleaned, as shown in FIG. 10. In this state in which the plate Mp of the cleaning mop M takes the inclined position, the cleaning mop M cannot be smoothly moved with respect to the surface to be cleaned during the wiping operation.

In the aforementioned structure, furthermore, the dust collecting effect is enhanced by trapping a relatively large piece of dust in the indented spaces 32*a* or 32*b*. If the cleaning mop M is moved in the inclined position, however, an end of the peripheral edge portion 31*b* of the sheet 31, as shown in FIG. 8, or the edge portion M2 of the cleaning mop M, as shown in FIG. 9, comes into contact with the surface to be cleaned. As a result, the leading side of the indented space 32*a* or 32*b* in the direction of movement (i.e., the direction X) of the cleaning mop M becomes closed. This prevents the entrance of dust into the indented space 32*a* or 32*b* and raises the problem that the dust collecting effect is not sufficiently achieved.

SUMMARY OF THE INVENTION

The present invention solves the aforementioned problems in the prior art and has an object to provide a cleaning sheet enabling collecting dust in a stable position while enhancing the dust collecting ability.

The present invention provides a cleaning sheet which is to be attached to a cleaning tool during use, the cleaning sheet comprising a wiping region having a wiping layer and attaching regions positioned on both sides of the wiping region, wherein a plurality of recesses are formed at intervals along boundaries between the wiping region and the attaching regions such that the recesses extend from the boundaries toward the center of said wiping region.

With this invention, when the cleaning sheet is attached to the cleaning tool (a cleaning mop, for example), the recesses can trap a relatively large piece of dust and guide fine dust particles to the center of the wiping region while preventing the cleaning sheet from inclining with respect to a surface to be cleaned (the floor, for example).

DETAILED DESCRIPTION OF THE INVENTION

The present invention is described hereinafter with reference to the accompanying drawings.

Figure 1:
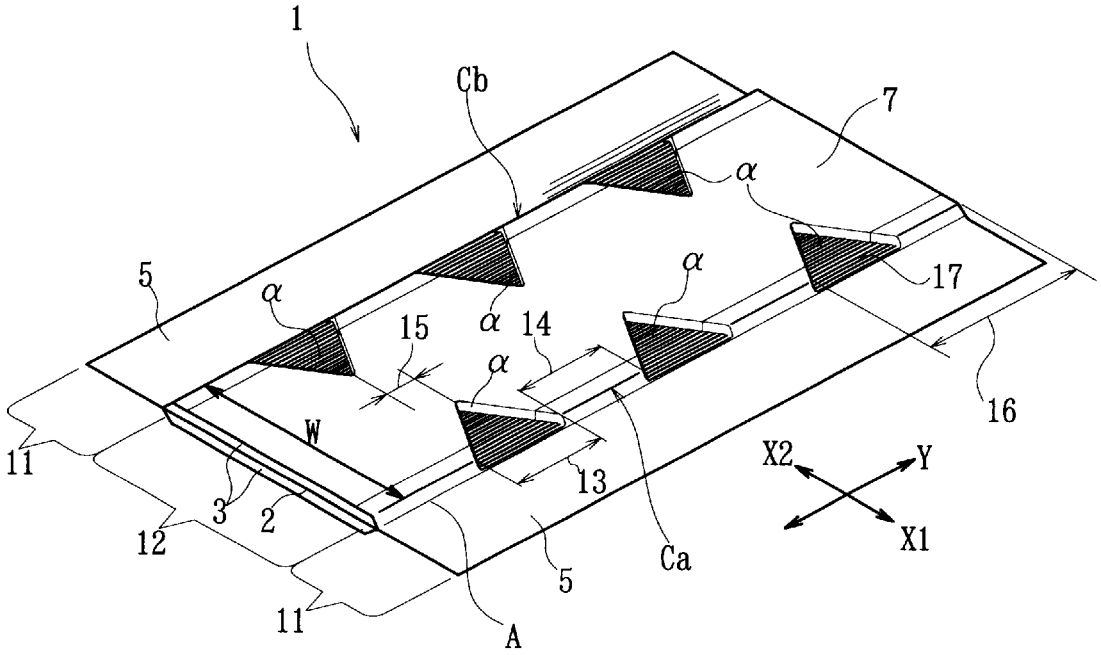
FIG. 1 is a perspective view showing an embodiment of a cleaning sheet of the invention.
Figure 2:
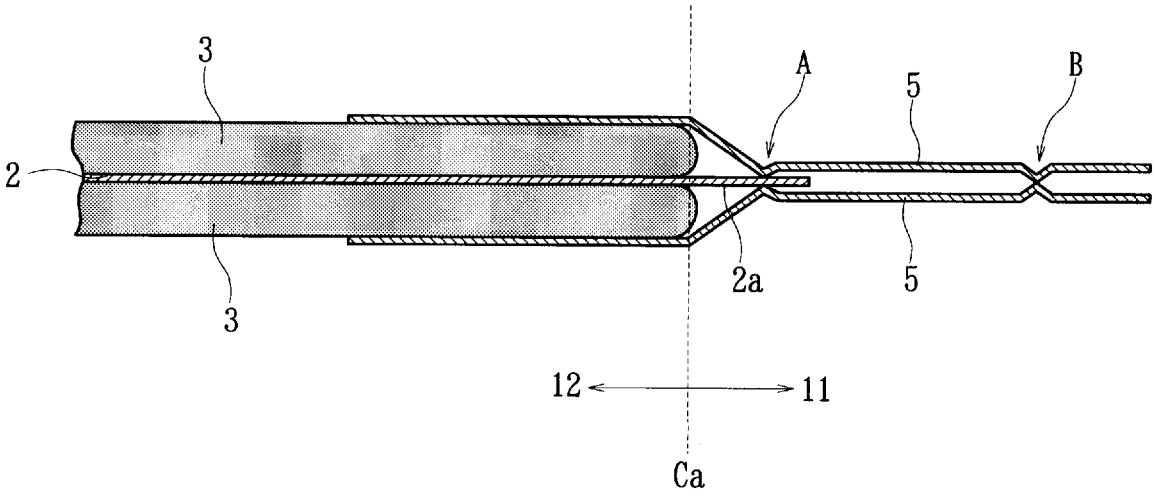
FIG. 2 is an enlarged section showing the structure of an edge portion of the cleaning sheet of FIG. 1.
Figure 3:
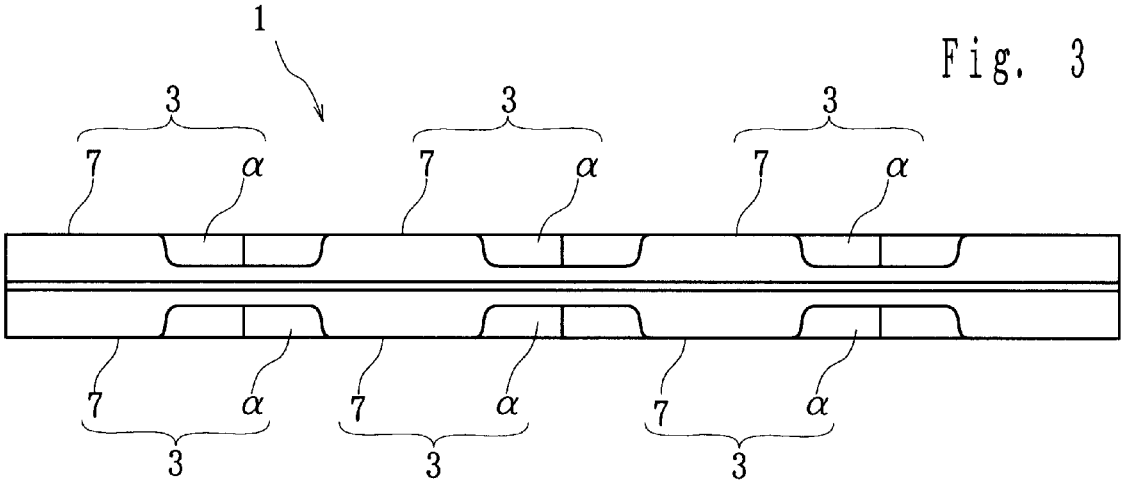
FIG. 3 is a side view of the cleaning sheet of FIG. 1.

FIG. 1 is a perspective view showing an embodiment of a cleaning sheet of the invention; FIG. 2 is an enlarged section showing the structure of an edge portion of the cleaning sheet; and FIG. 3 is a side view of the cleaning sheet of FIG. 1, as seen from a direction X1 or X2.

As shown in FIG. 1, a cleaning sheet 1 is composed of a rectangular sheet substrate 2, wiping layers 3 and auxiliary sheets 5. The wiping layers 3 are in a rectangular shape having a smaller width size (taken in a direction X) than that of the rectangular sheet substrate 2 while having the same length size (taken in a direction Y). The wiping layers 3 are placed on both surfaces of the sheet substrate 2 so that two side portions of the sheet substrate 2 form protrusions 2*a*, as shown in FIG. 2. The auxiliary sheets 5 are provided on both surfaces of each of the protrusions 2*a*. Here, as shown in FIG. 2, the auxiliary sheets 5 extend over side edge portions of the wiping layers 3 so that each side edge portion of the wiping layers 3 is sandwiched between the sheet substrate 2 and the auxiliary sheet 5. The upper and lower auxiliary sheets 5 are joined to the protrusion 2*a* of the sheet substrate 2, at a portion indicated by A, and are joined to each other, at a portion indicated by B. Moreover, the wiping layers 3 are joined to the sheet substrate 2, or the sheet substrate 2 and the auxiliary sheets 5 at recesses α, which will be described after, and at other portions, if necessary.

As shown in FIG. 1, the cleaning sheet 1 has a wiping region 12 and attaching regions 11. The wiping region 12 is identical to the region, where the wiping layers 3 are provided, and comes into contact with a surface to be cleaned, such as the floor, during wiping operations. On the other hand, the attaching regions 11 are positioned on both sides of the wiping region 12 and are affixed to a cleaning tool such as a cleaning mop during wiping operations.

The sheet substrate 2 and the auxiliary sheets 5 are made of thermal bonded non-woven fabric, spun-bonded non-woven fabric, spun-laced non-woven fabric or the like, and contain thermally weldable fibers (or thermoplastic fibers) such as single fibers or composite fibers of polyethylene (PE), polypropylene (PP) or polyethylene terephthalate (PET). Especially, the auxiliary sheets 5 are preferably, from a strength standpoint, made of a spun-bonded non-woven fabric. Alternatively, the sheet substrate 2 and the auxiliary sheets 5 may be made of a film or paper. On the other hand, the wiping layer 3 is formed of filaments, a split yarn, strip-shaped materials, or a combination of these. The filaments are produced in the form of tow, in which the filaments extend in one direction. The split yarn is produced by finely splitting a resin film into the net-like shape or the like, in which branched portions constructing the net-like shape or the like extend generally in one direction. The strip-shaped materials are produced by cutting a resin film or nonwoven fabric into strips. The strip-shaped materials are then bundled to extend in one direction. The filaments, split yarn and strip-shaped materials are also formed of PE, PP, PET, or composites of these, which can be thermally welded.

In this embodiment, because the sheet substrate 2, the auxiliary sheets 5 and the wiping layers 3 all contain the thermally weldable fibers (or thermoplastic fibers), the auxiliary sheets 5 and the sheet substrate 2 can be thermally welded at the portion A, as shown in FIG. 2. Here, the auxiliary sheets 5 can be thermally welded to each other at the portion B. Moreover, the wiping layers 3 can be thermally welded to the sheet substrate 2, or the sheet substrate 2 and the auxiliary sheets 5 at the recesses α and the other portions as will be described hereinafter.

Alternatively, the wiping layers 3 may also be formed of a bulky non-woven fabric having a low fibrous density, such as an air-through non-woven fabric. In this case, the wiping layers 3 may be adhered to the sheet substrate 2 by a hot-melt type adhesive, or thermally welded to the sheet substrate 2 as before when the wiping layers 3 contains thermoplastic fibers.

In the cleaning sheet 1 shown in FIG. 1, a plurality of recesses a are formed along boundaries Ca and Cb between the wiping region 12 and the attaching regions 11 such that they extend from the boundaries Ca and Cb into the wiping region 12. Each recess α is given a planar shape such that its width (i.e., the size in the direction Y) is largest at the boundaries Ca and Cb and becomes gradually smaller toward the center of the wiping region 12. In this embodiment, the recess a has a triangular shape. Alternatively, the recess α may be in a "U" shape. Here, the largest width size, at the boundary Ca or Cb, of the recess α is indicated by 13.

Along the boundaries Ca and Cb, the recesses α are formed at a constant interval 14. In the invention, in order to trap dust by the recesses a effectively while preventing the inclination in the wiping operation, a ratio of the width 13 to the interval 14 is preferably from 80:20 to 20:80, more preferably from 60:40 to 40:60. Further, it is preferable that about 10% or more of each end portion, as exemplified by numeral 16 in FIG. 1, of the boundaries Ca and Cb is designed for the interval 14, when the end portion 16 is set 25% of the length of the boundary Ca or Cb. Moreover, the recesses α, as arranged along the boundary Ca, and the recesses α, as arranged along the boundary Cb, are staggered from each other by a distance 15 in the direction Y. This arrangement enables the recesses α along the boundary Ca and recesses a along the boundary Cb to mop up the dust from the different portions on the surface to be cleaned, when the cleaning sheet 1 is moved over the surface in the direction X1 and in the direction X2.

These recesses α can be formed by pressing or heat-pressing the wiping layers 3 or by thermally welding the wiping layers 3 and the sheet substrate 2 when both contain thermoplastic fibers. In this case, the recesses α may be pressed, heat-pressed or thermally welded all over their surfaces, but then the fibers of the wiping layers 3 in the recesses α cannot exhibit the dust collecting effect sufficiently. In order to enable the dust collecting effect by the fibers in the recesses α, therefore, these recesses a are preferably formed by partially pressing or partially heat-pressing the wiping layers 3 using embossing rollers or heat-embossing rollers or partially thermally welding the wiping layers 3 to the sheet substrate 2 using embossing rollers or an ultrasonic horn and an anvil. In each of the recesses α, as shown in FIG. 1, thermally welded portions 17 (or, pressed (or embossed) portions or heat-pressed (or heat-embossed) portions) are formed in a stripe pattern. Here, the thermally welded portions 17 in a stripe pattern extend in the direction Y and are arranged at a small pitch in the direction X. Alternatively, the thermally welded portions 17 (or, pressed portions or heat-pressed portions) may be formed in a dotted pattern or the like.

When this cleaning sheet 1 is viewed in the direction X1 or X2, as shown in FIG. 3, the wiping layers 3 are thinned at the recesses α and thickened at the remaining portions to provide a bulky portion (or a thick portion) 7. This bulky portion 7 is given the maximum width size W equal to the width size of the wiping region 12, as shown in FIG. 1.

Incidentally, the wiping layers 3 are to be provided only in either one surface of the sheet substrate 2 or on both the surfaces of the sheet substrate 2. In short, the wiping layers 3 may be provided on at least one surface of the sheet substrate 2. When the wiping layers 3 are provided on the both surfaces of the sheet substrate 2, the aforementioned recesses α may be formed either in only the wiping layer 3, on one side or in both of the wiping layers 3.

Figure 7:
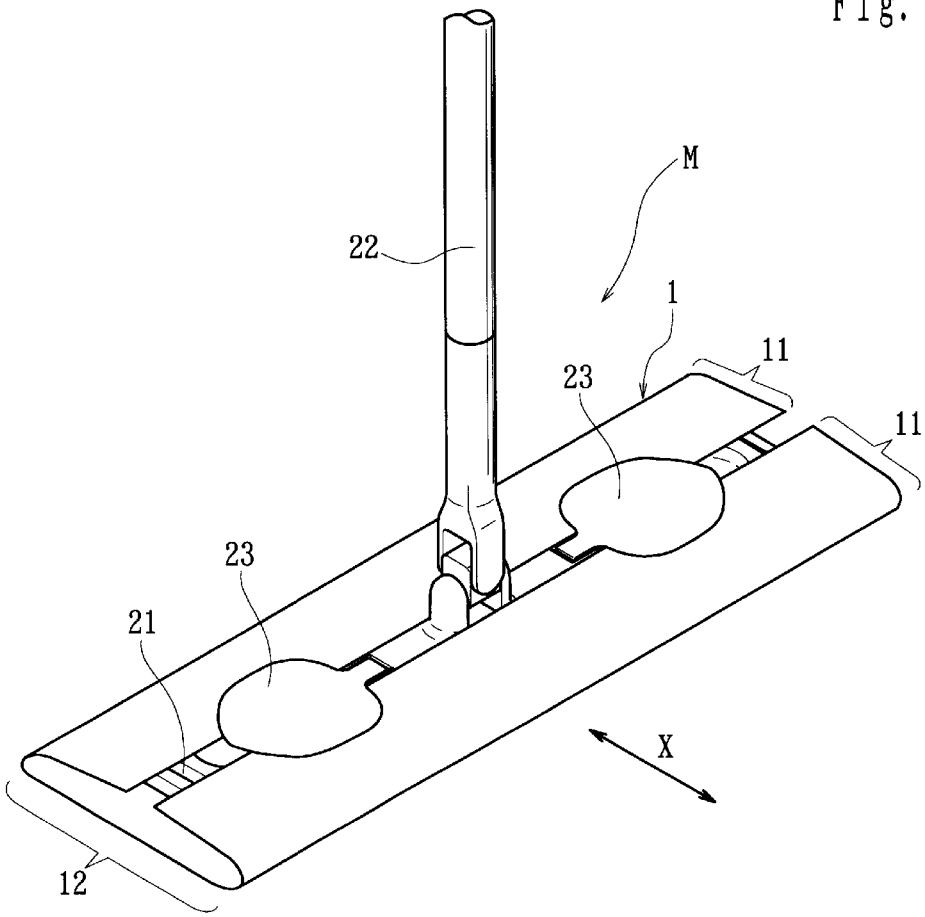
FIG. 7 is a perspective view showing one example of the using mode of the cleaning sheet.
Figure 8:
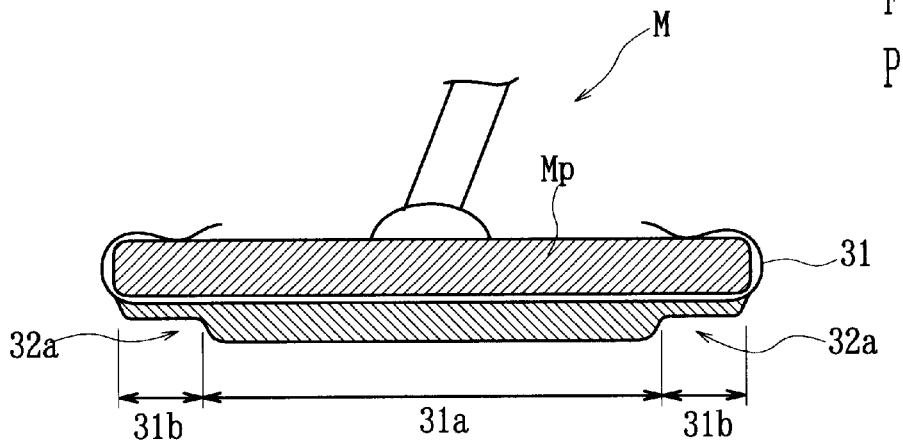
Fig. 8 PRIOR ART
FIG. 8 is a section showing the state in which a cleaning sheet of the prior art is attached to a mop.
Figure 9:
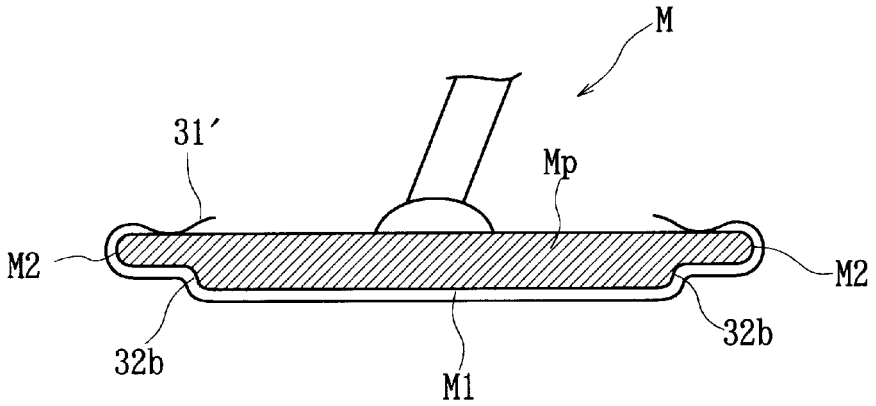
Fig. 9 PRIOR ART
FIG. 9 is a section showing the state in which a cleaning sheet is attached to a mop of the prior art.
Figure 10:
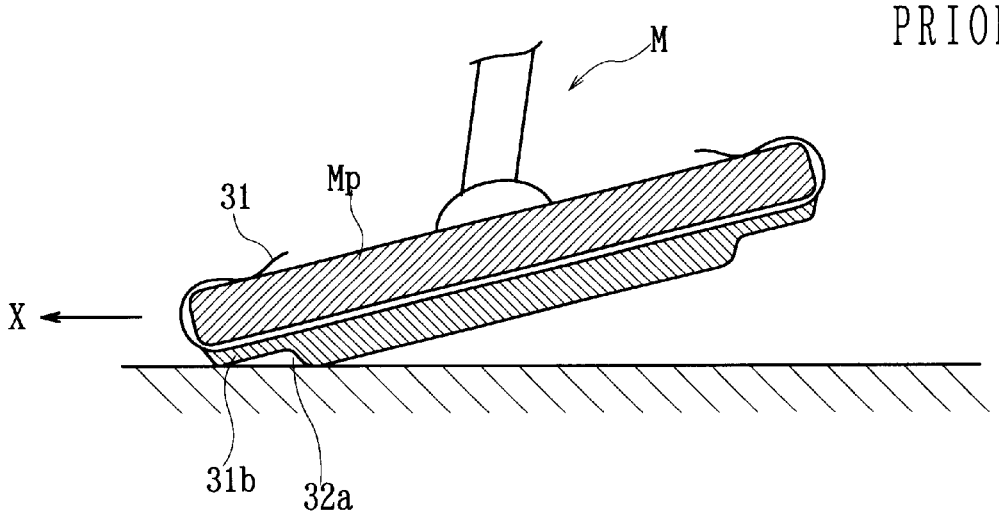
Fig. 10 PRIOR ART
FIG. 10 is a section showing the using state of the cleaning sheet of the prior art shown in FIG. 8.

FIG. 7 is a perspective view showing one example of the actual mode of using the cleaning sheet 1. In FIG. 7, the cleaning sheet 1 is attached to a cleaning mop M for wiping operations. The cleaning mop M is composed of a plate 21 having a flat bottom face and an upper face and a handle 22 jointed to the upper face of the plate 21. The wiping region 12 of the cleaning sheet 1 is so placed on the flat bottom face of the plate 21 as to confront a surface to be cleaned such as the floor, and the attaching regions 11 of the cleaning sheet 1 are wrapped up and held on the upper face of the plate 21 by holding clips 23. Here, the width of the wiping region 12 of the cleaning sheet 1 (i.e., the maximum width W of the bulky portion 7) and the width of the plate 21 are substantially equalized. However, no serious problem arises even if the width of the plate 21 is slightly smaller than that of the wiping region 12. In this case, the plate 21 and the wiping region 12 can be positioned roughly relative to each other.

When the cleaning sheet 1 thus attached to the plate 21 of the cleaning mop M is moved in the directions X1 and X2 along the surface to be cleaned, the wiping region 12 of the cleaning sheet 1 comes into contact with the surface to be cleaned with the aforementioned width W. As a result, the contact between the wiping region 12 and the surface to be cleaned is stabilized such that the inclination of the plate 21 is eliminated (unlike the prior art).

Since the recesses (or the thin portions) α are formed along the boundaries Ca and Cb, moreover, they can effectively trap relatively large pieces of dust on the surface to be cleaned when the cleaning sheet 1 attached to the plate 21 is moved in the directions X1 and X2 along the surface to be cleaned. Furthermore, since fine dust particles on the surface to be cleaned are also trapped in the recesses α and introduced into the central portion of the wiping region 12, the fine dust particles are readily collected by the bulky portion 7. In contrast to the prior art, this prevents the dust from being collected only by the side portions of the wiping region 12. As a result, the wiping operation can be performed by making effective use of the whole area of the wiping region 12.

Especially if the wiping layers 3 are pressed, heat-pressed or thermally welded in a stripe shape extending in the direction Y, in a dotted shape or the like, to form the recesses α, the fibers in the recesses a readily collect dust. Further, if the recesses α are in a triangular shape, their triangular crests facing toward the center of the wiping region 12 readily trap the relatively large pieces of dust. Moreover, if the recesses α along the boundary Ca and the recesses α along the boundary Cb are displaced in the direction Y, that is, staggered from each other, the dust can be effectively trapped from the different portions on the surface to be cleaned by using both the recesses α along the boundary Ca and the recesses α along the boundary Cb when the cleaning sheet 1 attached to the plate 21 is moved in the directions X1 and X2 (i.e., backward and forward).

Figure 4:
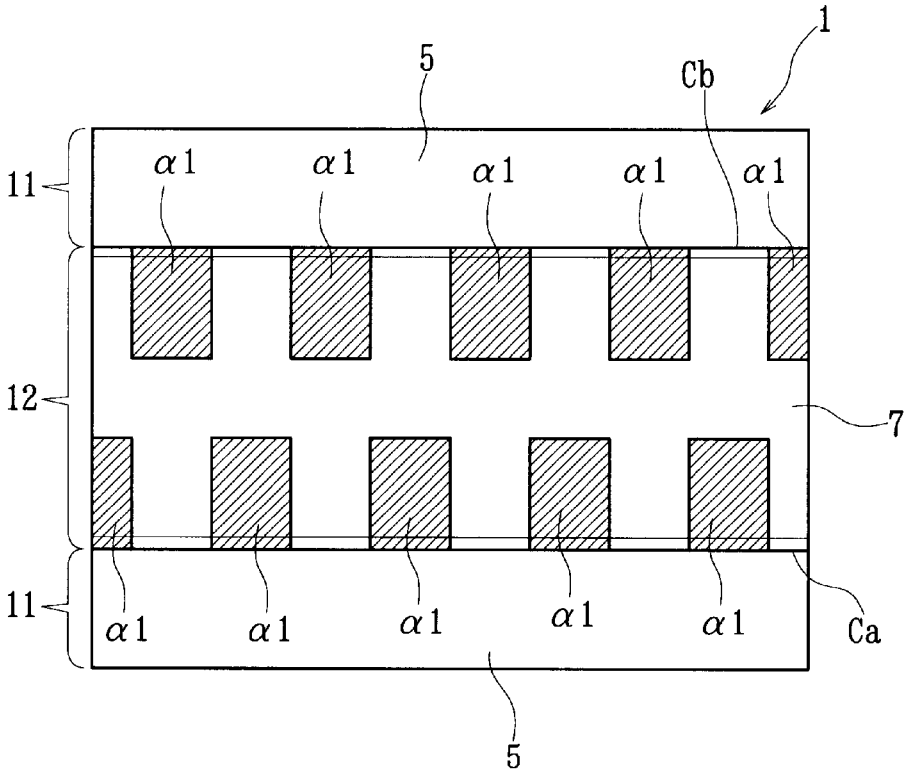
FIG. 4 is a top plan view of a cleaning sheet of another example of the shape of recesses.

FIG. 4 is a top plan view showing another example of the shape of the recesses.

In the cleaning sheet shown in FIG. 4, rectangular recesses α1 are formed along the boundaries Ca and Cb. By forming the recesses into this shape, the dust can also be trapped reliably and efficiently as in the previous example.

The shape of the recesses should not be limited to the shape of the triangle, letter "U" or rectangle but may be formed into a square shape, semicircular shape or the like.

Figure 5:
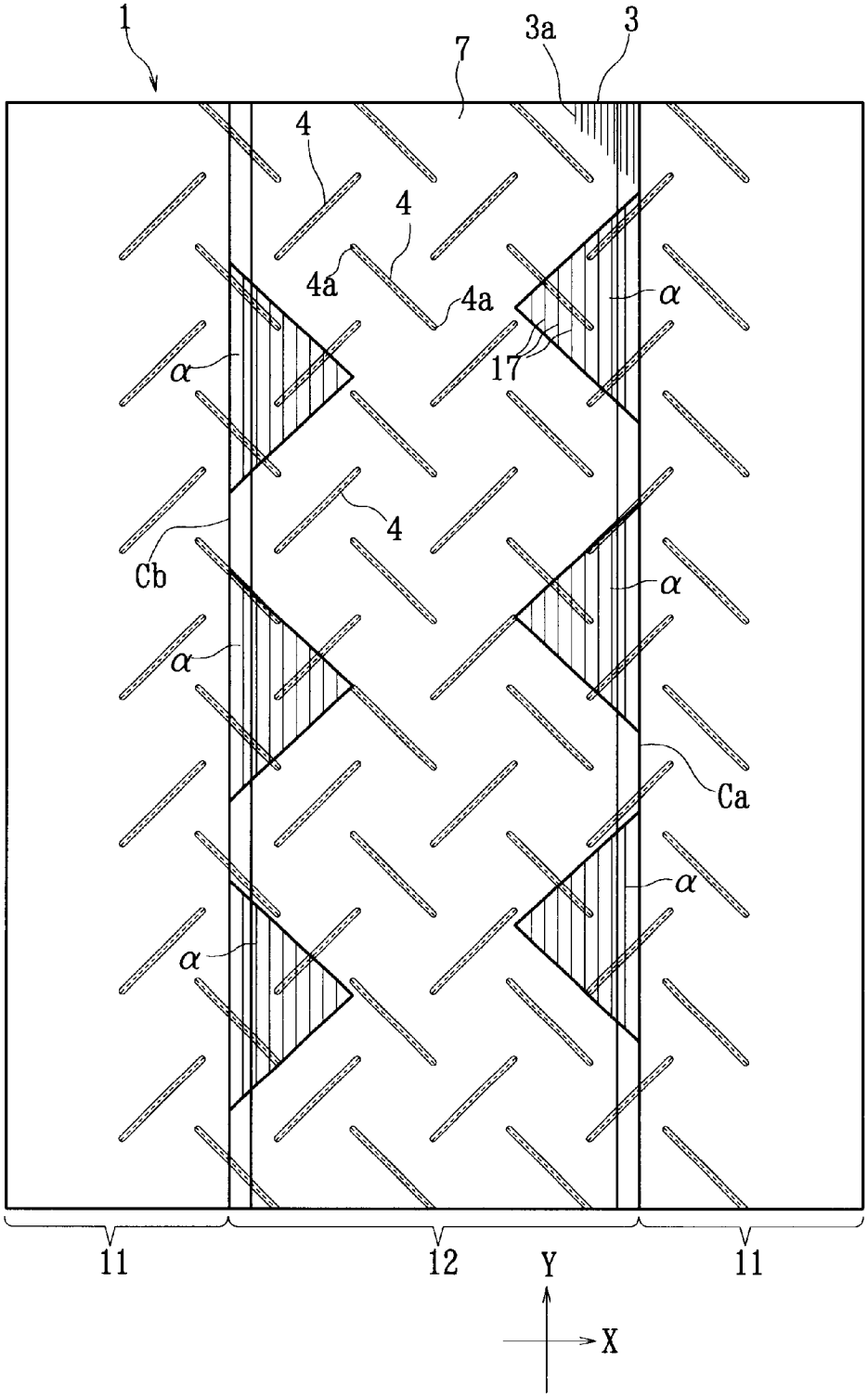
FIG. 5 is a top plan view showing a more detailed structure of the case in which wiping layers of the cleaning sheet are formed of filaments.
Figure 6:
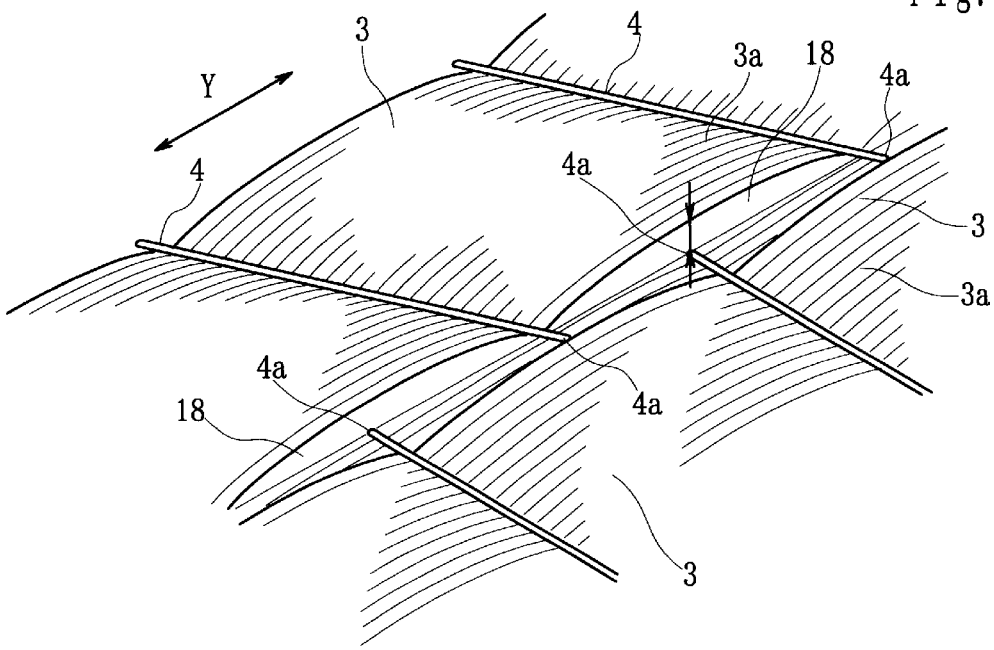
FIG. 6 is an enlarged perspective view showing a portion of the cleaning sheet shown in FIG. 5.

FIG. 5 is a top plan view showing a more detailed structure of the case in which the wiping layers 3 of the cleaning sheet 1 are formed of the filaments, and FIG. 6 is an enlarged perspective view showing a portion of the cleaning sheet 1 shown in FIG. 5.

As before, this cleaning sheet 1 is constructed by providing the wiping layers 3 on both the surfaces of the sheet substrate 2 and by providing the auxiliary sheets 5 on both the surfaces of the respective protrusions 2*a* of the sheet substrate 2.

The wiping layer 3 is formed of a number of filaments 3*a* each extending in one direction (or in the direction Y). That is, the wiping layer 3 is formed by opening (or flattening) the tow of the filaments 3*a*. Here, the individual filaments 3*a* extend over the entire length of the cleaning sheet in the direction Y. In this case, because the wiping layer 3 is formed by using the tow almost as it is, the formation of the wiping layer 3 can be made simple. Alternatively, the wiping layer 3 may be formed of the split yarn or the bundle of the strip-shaped materials such that the split yarn or each of the strip-shaped materials extends over the entire length of the cleaning sheet in the direction Y likewise. In this cleaning sheet 1, thermally welded lines 4 are arranged in a herring-bone pattern over the wiping region 12, where the wiping layers 3 are provided, and the attaching regions 11. All these thermally welded lines 4 extend obliquely with respect to the directions X and Y so that they extend across the orientation of the filaments 3*a*, thereby preventing the individual filaments 3*a* from dropping from the cleaning sheet 1. Moreover, each end portion 4*a* of each thermally welded line 4 is inserted between two adjacent thermally welded lines 4 and 4 in the direction Y.

As a result, the filaments 3*a*, as held between the aforementioned two thermally welded lines 4 and 4, as shown in FIG. 6, are partially pushed onto the sheet substrate 2 by the end portions 4*a* of the thermally welded lines 4 inserted therebetween, thereby forming pockets 18. These pockets 18 can trap fine dust particles effectively.

On the other hand, the thermally welded portions 17 (or pressed portions or heat-pressed portions) in the recesses α in a striped pattern as described before.

In the cleaning sheet, as shown in FIG. 5, the recesses α can effectively trap relatively large pieces of dust while introducing fine dust particles to the central portion of the wiping region 12, so that the introduced fine dust particles are efficiently collected by the pockets 18 shown in FIG. 6 at the bulky portion 7. This structure makes it possible to use the whole area of the wiping region 12 more effectively.

Here, the use of the cleaning sheet of the invention should not be limited to the case in which it is attached to the cleaning mop M as shown in FIG. 7. The cleaning sheet can also be used by attaching it to a handy mop or the like, or by holding it by hand.

Further, the cleaning sheet of the invention is preferably impregnated with an oily agent for adsorbing fine dust particles easily. This oily agent is exemplified by a mineral oil such as paraffins, a synthetic oil such as polyolefins, a silicone oil or a surface active agent. Further, the wiping region 12 may be impregnated with the oily agent only at the bulky portion 7 except for the recesses α. In this case, relatively large pieces of dust can be trapped at the recesses α whereas fine dust particles can be held by the bulky portion impregnated with the oily agent.

Moreover, the cleaning sheet of the invention can be impregnated with not only the above-specified oily agents but also an agent such as a deodorizer, a humectant or an anti-fungus agent.

Incidentally, the recesses of the invention may be formed in another way. For example, the recesses can be formed such that a bulky non-woven fabric, a foamed resin material or a rubbery material as the sheet substrate of the invention is pressed or embossed to be recessed, and a thin non-woven fabric such as a spun laced non-woven fabric as the wiping layer of the invention is laid over the surface of the sheet substrate to join the sheet substrate and the wiping layer.

According to the invention thus far described, the recesses are formed at intervals along the side portions of the wiping region so that the position of the cleaning sheet can be stabilized in the wiping operation.

Moreover, dust can be guided to the central portion of the cleaning sheet from the recesses formed along the side portions of the wiping region and can be collected by the entire wiping region so that the whole cleaning sheet can be effectively exploited without any waste.

In the foregoing specification, the invention has been described in relation to preferred embodiments and many details have been set forth for the purpose of illustration. It will be apparent to those skilled in the art that the invention is susceptible to additional embodiments and that certain of the details described herein can be varied considerably without departing from the basic principles of the invention.

Further, 'comprises/comprising' when used in this specification is taken to specify the presence of stated features, integers, steps or components but does not preclude the presence or addition of one or more other features, integers, steps, components or groups thereof.

What is claimed is:

1. A cleaning sheet for attachment to a cleaning tool during use, the cleaning sheet comprising:

a wiping region having a wiping layer and attaching regions positioned on both sides of the wiping region, wherein a plurality of recesses are formed at intervals along boundaries between the wiping region and the attaching regions such that the recesses extend from the boundaries toward a center of said wiping region.

2. The cleaning sheet according to claim 1, wherein the recesses are in a plane shape such that a width thereof, as taken in a direction parallel to the boundaries, is largest at the boundaries and becomes gradually narrower toward the center of said wiping region.

3. The cleaning sheet according to claim 2, wherein the recesses along a boundary on one side of the wiping region and the recesses along a boundary on another side of the wiping region are staggered in the direction parallel to the boundaries.

4. The cleaning sheet according to claim 3, wherein a ratio of the width of the recess to the interval is from 80:20 to 20:80, with respect to the boundary.

5. The cleaning sheet according to claim 4, wherein each of said recesses is formed by one of pressing, heat-pressing and thermally welding the wiping layer.

6. The cleaning sheet according to claim 5, wherein each of said recesses is formed by partially thermally welding the wiping layer to form a plurality of thermally welded portions.

7. The cleaning sheet according to claim 6, wherein the thermally welded portions are stripe patterned.

8. The cleaning sheet according to claim 7, further comprising:

a sheet substrate having the wiping layer disposed on one surface.

9. The cleaning sheet according to claim 8, wherein the wiping layer is formed of at least one of filaments, a split yarn and strip-shaped materials.

10. The cleaning sheet according to claim 7, further comprising:

a sheet substrate having the wiping layer disposed on each surface.

11. The cleaning sheet according to claim 10, wherein the wiping layer is formed of at least one of filaments, a split yarn and strip-shaped materials.

* * * * *